United States Patent [19]

Miller

[11] Patent Number: 4,889,048

[45] Date of Patent: Dec. 26, 1989

[54] HIGH HEAT FLUX ROLL AND PRESS UTILIZING SAME

[76] Inventor: Ray R. Miller, 8816 Warren Dr. NW., Gig Harbor, Wash. 98335

[21] Appl. No.: 181,100

[22] Filed: Apr. 13, 1988

[51] Int. Cl.[4] ..... B30B 15/34

[52] U.S. Cl. ..... 100/93 RP; 34/116; 162/358; 100/118; 100/153; 100/162 R

[58] Field of Search ..... 100/93 RP, 118, 119, 100/120, 153, 162 B, 162 R; 29/116.2, 113.2; 34/116, 118, 123; 162/358, 359, 361

[56] References Cited

U.S. PATENT DOCUMENTS

| | | | |
|---|---|---|---|
| 3,319,352 | 5/1967 | Haigh | 34/123 |
| 3,362,055 | 1/1968 | Bryce | 29/113 |
| 3,430,319 | 3/1969 | Skaugen | 29/116 |
| 3,802,044 | 4/1974 | Spillman | 29/113 AD |
| 3,853,698 | 12/1974 | Mohr | 162/358 |
| 4,090,553 | 5/1978 | Beghin | 164/448 |
| 4,183,128 | 1/1980 | Marchioro | 29/116 AD |
| 4,358,993 | 11/1982 | Spillman et al. | 99/483 |
| 4,520,723 | 6/1985 | Pav et al. | 100/162 B |
| 4,710,271 | 12/1987 | Miller | 162/360.1 |

FOREIGN PATENT DOCUMENTS 3102356 8/1982 Fed. Rep. of Germany .

OTHER PUBLICATIONS

Farrel, n.d., Bulletin No. 134, Nipco and Tri-Pass Rolls (date unknown).

Escher Wyss, n.d., Advances in NIPCO Roll Applications (date unknown).

Escher Wyss, 1979, Line Force Distribution Control.

Escher Wyss, 1981, New Solutions in Calendar Design (reprint from Pulp and Paper, Canada, No. 7, 1981.

*Primary Examiner*—Harvey C. Hornsby
*Assistant Examiner*—K. O'Leary
*Attorney, Agent, or Firm*—Keith D. Gehr

[57] ABSTRACT

The disclosure describes a drum or roll which may be heated to high operating temperatures and is particularly useful in situations where a high heat flux is required under conditions of high nip and distributed loads on the drum. It consists of a relatively thin rotating shell supported on an axially located stationary inner core. The core has a plurality of shell support bearings. These have close radial clearances with the inner surface of the shell at each location where an extrnal nip roll would be engaged. The spaces between the shell support bearings form pressurizable chambers. These chambers can be filled with a hot pressurized fluid for supporting the shell between the supports located at the nip positions. In one application the roll would be used as the drum in a belt and drum press having high nip loads at several locations and high distributed loads applied by a tensioned belt. The fluid support system for the rotatable shell enables a very thin shell to be used. This permits the desired heat flux while still maintaining the mechanical integrity to support the applied loads. Operating temperatures of the roll could range up to 800° F. with multiple nip loads typically being up to 1000 to 2000 pounds per linear inch and 100-800 psi unit pressure, and with distributed loads between the nips of up to 50 psi. High thermal conductivity materials such as copper or aluminum may be used as shell material to reduce temperature differential and thermal stress.

24 Claims, 6 Drawing Sheets

THERMAL/CONDUCTIVITY K - Btu/[Hr(ft2/ft)°F]
COPPER K= 200 APPROX.
ALUMINUM = 100 APPROX.
ALUM. BRONZE= 50 APPROX.
STEEL = 25 APPROX.

HIGH HEAT FLUX ROLL AND PRESS UTILIZING SAME

BACKGROUND OF THE INVENTION

The present invention is directed to a roll or drum capable of rapidly transferring large quantities of heat to a material in contact with the drum surface. The roll is especially well adapted for use in a press of the type in which a drum is wrapped with a tensioned belt holding an interposed material tightly in contact with the drum.

One belt and drum press of the general type described above is disclosed in U.S. Pat. No. 3,319,352 to Haigh. A preferred press is shown in U.S. Pat. No. 4,710,271 to Miller. This latter inventor shows a system which includes two belt tensioning rolls which also form nip contact with the drum through the interposed belt. Preferably, additional idler nip rolls are also included. One particular advantage of this press is the balanced construction whereby pressing forces are not transmitted to the supporting framework. This enables the drum to be floating with respect to the nip rolls. In one version of the press the drum is a hollow cylinder which can be directly heated. A number of optional construction patterns are shown which enable relatively high heat flux without undue stress caused by a high temperature differential across the drum. In addition to the direct heated versions, an alternative version employs a steam heated drum. Here the drum is made with a thin outer shell to obtain maximum heat transfer. This is supported by a series of longitudinal ribs fixed to a relatively heavy walled inner drum which withstands the load stresses applied by the belt and nip rollers.

The drums in the direct fired versions of the above press suffer from competing requirements. The shell must be of adequate thickness to withstand the very high loads imposed at the nip zones. On the other hand it must be relatively thin to avoid the high thermal stress which would be created by a high temperature differential across the drum wall. These requirements tend to force a compromise solution which results in a lower than desired heat transfer rate. The other versions of the press using steam heated drums similarly suffer from the fact that steam heat begins to be impractical over 400° F. because an increasingly adverse pressure/temperature relationship requires excessive pressure levels.

In an effort to resolve the competing problems of obtaining high temperature levels at extremely high rates of heat flow from the drum to the contacting work material, while maintaining adequate drum strength and integrity, the present inventor has sought solutions quite different from those described in the above noted U.S. Pat. No. 4,710,271. The problem is exacerbated by the diversity of loading on the preferred press; i.e., very high concentrated nip loads and extensive large area distributed loads from the tensioned belt. Paper machine widths may be as great as 400 inches and nip pressures in press and calendar sections are very high. Roll deflection can become a very serious additional problem unless extremely heavy construction is used.

Hydraulically supported rolls are well known in the paper and printing industry as an answer to the deflection problem. These are typically designed with a relatively heavy rotating shell supported on a fixed inner core portion. A number of hydraulic bearing support elements are arranged longitudinally along the core. These can be adjusted to resist deflection caused by an opposing roll and to obtain uniform nip pressures. Using general systems of this type, the overall size and weight of the resulting rolls can be reduced significantly over that which would be required for solid rolls and deflection avoided entirely. There are other advantages as well in that deflection can be controlled differentially from side to side across the rolls if desired.

Reference is made here to a number of earlier patents which are generally related to the present invention. All of these deal with hydraulically supported rolls in which a rotating shell is supported on a stationary core. Typical of the rolls of this type is the one shown by Marchioro in U.S. Pat. No. 4,183,128. Here a heavy rotatable shell is supported on a plurality of longitudinal jack-like hydraulic pressure elements, each of which has individual pressure regulators located in the fixed support.

Spillman et al., in U.S. Pat. No. 3,802,044, show a heavy shell roll held on a multiplicity of individual fixed bearings located on the core portion. The bearings can individually adjust to shaft deflection without loss of proper face-to-face contact at the interface with the shell. FIG. 9 of this patent shows the roll having angularly spaced apart hydraulic supports symmetrically arranged to resist the forces imposed by four outside rolls making nip contact.

Mohr, in U.S. Pat. No. 3,853,698, shows an extended nip press having a fixed hydraulically loaded anvil section and a superposed hydraulically supported press roll.

In U.S. Pat. No. 3,362,055, Bryce shows a heavy shell supported on a fixed core divided angularly into multiple compartments filled with a hydraulic oil. The roll can be further divided into two overall sections having differentially regulated oil pressures.

A pressure roll known as a "swimming" roll is widely available in the paper industry. In a roll of this type the heavy outside shell is supported on a core having opposed longitudinal seals approximately 180° apart. The roll is oriented so that it forms a nip with an opposing roll. The compartment facing the nip zone is filled with pressurized hydraulic oil while the other compartment is generally left empty.

One inventor recognized the situation in which different load types affect the deflection of a roll in a paper mill environment. Skaugen, in U.S. Pat. No. 3,430,319, described a breast or couch roll for a paper machine which is differentially hydraulically supported. One side of the roll is supported on a longitudinal fluid bearing designed to compensate for defection of the roll under its own weight. Angularly displaced from this is a second longitudinal fluid bearing which counters the resultant of the forces imposed by a traveling paper machine wire partially wrapped around the roll.

All of the above rolls are built with relatively thick shells. In general these shells will be a minimum of about 20 mm in thickness and may range up to 105 mm or even greater. Very commonly these rolls will be made from chilled cast iron. The present inventor is aware of two other hydraulically supported rolls having thin shell walls. One of these is detailed in West German Application No. 31 02 526 to Hauser et al. This invention is directed to an extended nip press roll. The outer shell is made of a flexible plastic material such as polyurethane. In U.S. Pat. No. 4,358,993, Spillman et al. show an internally heated, hydraulically supported roll suggested for the preparation of food products. This device has a thin flexible metal shell having multiple angularly displaced hydraulic support points. The hydraulic fluid which serves at the support points as a fluid bearing medium is heated and this also serves to heat the shell. Baffle strips divide the interior portion of the roll into different temperature zones. The volumes between these baffles form oil collection sumps where oil which leaks from the bearings is picked up for return to the heater. In this particular device the shell path and configuration is not fully circular but is somewhat tear drop-shaped in configuration. A drive roll is located inside the shell at the point of the tear drop. Because of this asymmetrical construction, which causes continual flexing, the shell would be limited to a very thin material, typically less than 2 mm in thickness.

None of the above rolls would be capable of solving the problem described earlier; i.e., that of operating at a high temperature to achieve a high rate of heat flow from the drum to a contact web while still maintaining adequate drum integrity under heavy nip and distributed loads. One solution to the problem appears to be found by hydraulically supporting a thin rotating drum shell which is mounted on a stationary load bearing core. The resulting drum, consisting of the core and shell, is filled with a hot heat transfer fluid which can also serve as the hydraulic support medium for the shell. In this way internal temperatures as high as 700°-800° F. are possible. The use of a very thin shell permits a high rate of heat transfer without inducing an unacceptable thermal stress in the shell material. Close matching of the internal hydraulic support to the external loads is necessary to minimize shell stress from mechanical loading.

SUMMARY OF THE INVENTION

The present invention is a drum or roll which can be used under conditions requiring high heat flow at high temperature with a combination of heavy nip and distributed mechanical loading. The invntion further comprises a belt and drum press utilizing the improved drum or roll.

The roll has a rotatable, essentially rigid but relatively thin outer shell. This is supported on an inner core located axially within the shell. The core has a plurality of circumferentially spaced apart bearing-like shell supports. These are designed to have a close radial clearance with the inner surface of the shell. While the core may have as few as two of these shell supports mounted thereon, more commonly it will have three or more. The spaces between adjacent supports form pressurizable chambers. These may be filled with a pressurized fluid to provide additional support for the shell in the angular space between the first noted supports.

The roll further has fluid supply lines for conducting a pressurized fluid to each of the chambers and fluid discharge lines, spaced apart in the chambers from the fluid supply lines, for conducting the fluid from each chamber for return to a supply source.

In use the roll is capable of withstanding high nip roll forces which are applied at the location of some or all of the bearing-like support means. The roll can further withstand the relatively lower distributed forces applied over the surface area between the nip rolls. By virtue of the internally and differentially supported thin shell a high heat flux through the shell can be obtained and tolerated when a heated fluid is introduced into the chambers in the interior portion of the roll.

For ease of description, the roll will be considered as it would function as the drum in a belt and press such as that described by Miller in U.S. Pat. No. 4,710,271. It will be understood by those skilled in the art that the present inventor considers the roll itself to be novel and its use would not be limited to presses of the types that will now be described.

In one form of drum and belt press, such as that shown by Haigh in U.S. Pat. No. 3,319,352, a rotatable drum is held in a supporting frame and a belt in tension is partially wrapped around the drum. The material to be pressed, normally in web form such as a paper product, is passed between the tensioned belt and the drum. Where moisture is being pressed from web a felt may also be used between the web and tensioned belt. Often a number of angularly spaced apart nip rolls will act against the drum through the belt to further increase the effectiveness of pressing the web.

The preferred type of press, such as that shown in U.S. Pat. No. 4,710,271, will have a pair of spaced apart belt tensioning rolls mounted on the supporting frame. These will be adjacent to and parallel to the drum. The belt will be endless and will have an inner generally U-shaped course and an outer generally U-shaped course. The inner and outer courses meet in loops which wrap around the tensioning rolls. Both tensioning rolls will be contained within the body of the belt and the drum will be outside of the body of the belt with the inner course being wrapped around more than half of the drum's circumference. At least one idler nip roll will also be contained within the body of the belt so that the inner and outer courses of the belt are spaced apart. The tensioning rolls and the idler nip roll or rolls all make nip contact with the drum through the belt. One of the rolls will normally be a driven roll to rotate the belt through its endless course around the drum. Finally, a tensioning device acts on the tensioning rolls to translate them relatively toward or away from each other to control the belt tension. These rolls and drum are free to adjust to each other during tensioning so that nip contact is maintained by all of the rolls.

In a particularly preferred version of the press the drum is free floating with respect to the tensioning rolls for ready response to tensioning adjustments. When this arrangement is used with the drum or roll of the present invention, a torque arm is connected between the drum core and the frame of the press to prevent rotation of the core.

The drum of the present invention would also be useful in a single long nip press such as that shown in Mohr, U.S. Pat. No. 3,853,698. A high capacity shell support would be used to match the area of the long external nip loading. One or more low capacity shell supports would be needed diametrically opposite the high capacity support in order to stabilize the thin walled shell. The large area pressurized support chambers would be used to support any other areas of the shell, including those that might be under tension belt pressure, as has been previously described. It is not a requirement that there must be a nip roll at every shell support.

It is desirable to maintain the drum or roll shell as thin as possible while still maintaining adequate mechanical strength. The maximum thickness of the shell should not exceed a dimension defined as $0.2\sqrt{k}$ inches, where k is thermal conductivity of the shell material expressed at Btu/hr/ft/°F. For a shell made thicker than that just described the thermal stress due to the temperature differential across the shell will limit the maximum heat flux.

Preferably, along any radial line the hydraulic support unit pressure at any point inside the rotating shell should be at least half the unit mechanical pressure at the corresponding point on the outer surface of the shell and, in any case, it should be closely matched to the external load.

It is self evident that the press will have a conventional heating mechanism to heat the fluid to the desired operating temperature as well as pumps and associated piping and necessary flow control valves.

The shell support elements at the nip locations may be fluid lubricated pad-type bearing shoes. These may be one of many known forms of support elements, such as those having pressurized fluid supplied to a noncontacting interior cavity of a supporting element.

It is preferable that two of the shell support elements at the nip locations be fixed in location relative to the inner support core. These would be nonmoving in order to fix the relative locations of the support core and rotating shell.

Other shell support elements at the nip locations may either be fixed or self adjusting. At least one of the latter type will facilitate assembly and operation of the drum. Self adjusting types of support elements may have travel limiting features incorporated into their construction to define the circular path of shell location.

The shell support bearings at the nip points may be made longitudinally continuous over essentially the full length of the drum or they can be segmented into shorter sections.

While all of the fluid supplied to the drum or roll will normally be heated, the bulk of the heat which is transferred to and through the shell will be from the chamber areas between the nip support bearings. In order to increase the heat transfer rate and promote temperature uniformity, the drum inner core may be profiled in the chambers in the volume defined between the fluid supply line and fluid discharge line. This profiling will direct the flowing fluid adjacent to the shell to improve the heat transfer rate and temperature uniformity.

It is an object of the present invention to provide a drum or roll adapted to have a very high rate of heat flux to a material in contact with the drum yet have sufficient mechanical strength to withstand heavy nip and distributed loads.

It is another object to provide a drum having a thin rotatable outer shell to enable high heat flux rates without undue thermal stress.

It is a further object to provide a belt and drum press in which the drum has the capability of an exceptionally high heat flux rate and a high operating temperature.

It is still another object to provide a hydraulically supported thin shelled drum which can withstand high linear nip loads and distributed loads without undue shell distortion or stress and can operate at the high speeds encountered in paper manufacture.

These and many other objects will become readily apparent to those skilled in the art upon reading the following detailed description taken in conjunction with the drawings.

DESCRIPTION OF THE PREFERRED EMBODIMENTS

Figure 1:
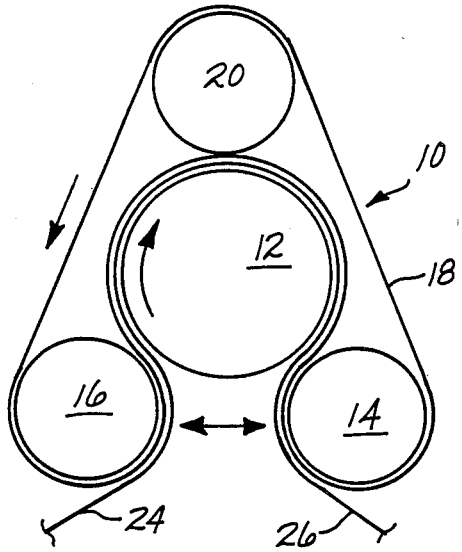
FIGS. 1 and 2 are representational side elevations of prior art drum and belt presses.

Reference should now be made to the figures. FIG. 1 shows a simplified side elevation of a belt and drum press of the type described in U.S. Pat. No. 4,710,271. The press 10 has a central drum 12 and a pair of opposed tensioning rolls 14, 16. An endless belt 18 is reeved around the tensioning rolls and the drum. Idler nip roll 20 is enclosed within the body of the belt, angularly displaced from the two tensioning rolls. Belt tension is controlled by moving the tensioning rolls 14, 16 relatively toward or away from each other. Note that all rolls remain in nip contact with the drum during tensioning adjustments. A sheet or web of material 24, which could be paper or a similar product, is seen entering the press between tension roll 16 and the drum 12. This exits as pressed web 26. Normally, in an application of this type the heated press would be used to dry the entering web, or to mechanically extract moisture from the web, or some combination of these.

Figure 2:
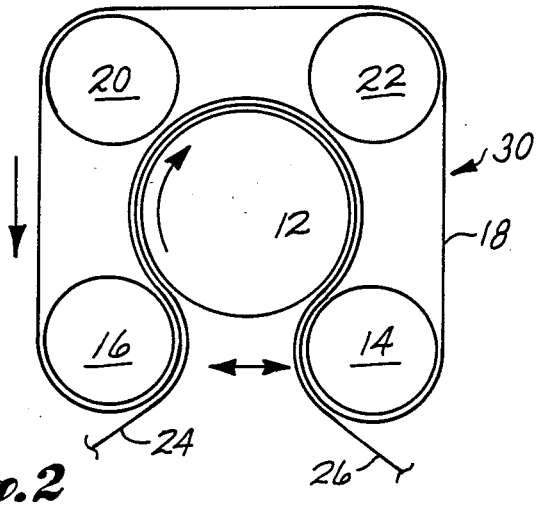

FIG. 2 is a slightly modified version 30 of the press using two idler nip rolls. In this case the new roll 22 has been added within the body of the belt in order to gain additional pressing capacity.

Figure 3:
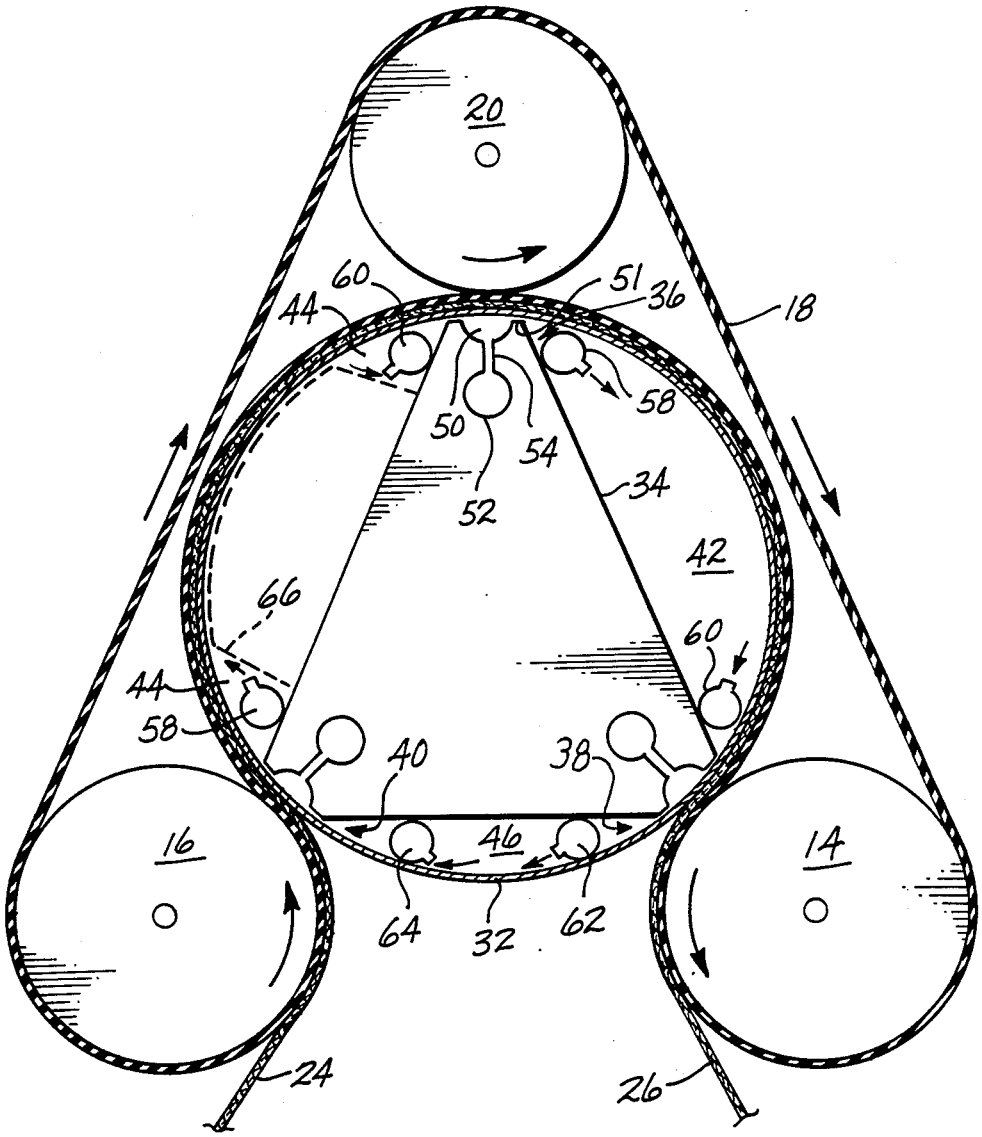
FIG. 3 is a representational side elevation of a similar drum and belt press using the improved drum of the present invention.

FIG. 3 is a cross sectional representation of the press of FIG. 1 in which the drum of the present invention is employed. The drum has a rotatable shell 32 supported on an axial, nonrotating, inner core 34. The inner core is shown as having apices 36, 38, 40 which form longitudinally continuous bearings or shell supports at the nip zones formed with tensioning rolls 14 and 16 and idler nip roll 20. In the area between the nip zone shell supports are found chambers 42, 44, and 46. There is a distributed load from the tensioned belt applied to the circumference of the drum overlying chambers 42 and 44. However, there is no such load applied to the surface of the drum lying between the tensioning rolls 14 and 16.

In the present simplified version of the interior core, each of the apices forming a nip position bearing for the shell has a fluid reservoir 50 with lands or bearing surfaces 51. This reservoir is supplied from a high pressure fluid supply manifold 52 through a series of longitudinally positioned orifices 54. A continuous flow of fluid over surfaces 51 is essential to provide the hydraulic bearing needed to support the shell.

Chambers 42 and 44 have longitudinal pipes or fluid supply lines 58 to distribute heated fluid to the chambers and similar return lines 60 located at the opposite edge of the chamber. The return lines serve to collect cooled fluid for return to the supply source.

In similar fashion, chamber 46 is supplied with heated fluid through a longitudinally oriented supply line 62 and the fluid is withdrawn through a similar return line 64. Under some circumstances it may be desirable to maintain the fluid to chamber 46 at a somewhat different pressure than that supplied to chambers 42 and 44 since the shell over the area of chamber 46 bears no distributed load.

It is desirable, to the extent possible, to direct the fluid entering the chambers from supply lines 60, 62 along the surface of the shell. Heat transfer uniformity can be improved by restricting the flow area. To achieve this end, inner core 34 may be profiled by inclusion of an optional portion 66, shown in dotted lines in chamber 44 of FIG. 3. This profiling can assume many forms and may be used in any or all of the chambers where it is desirable to achieve greater heat flux.

Figure 4:
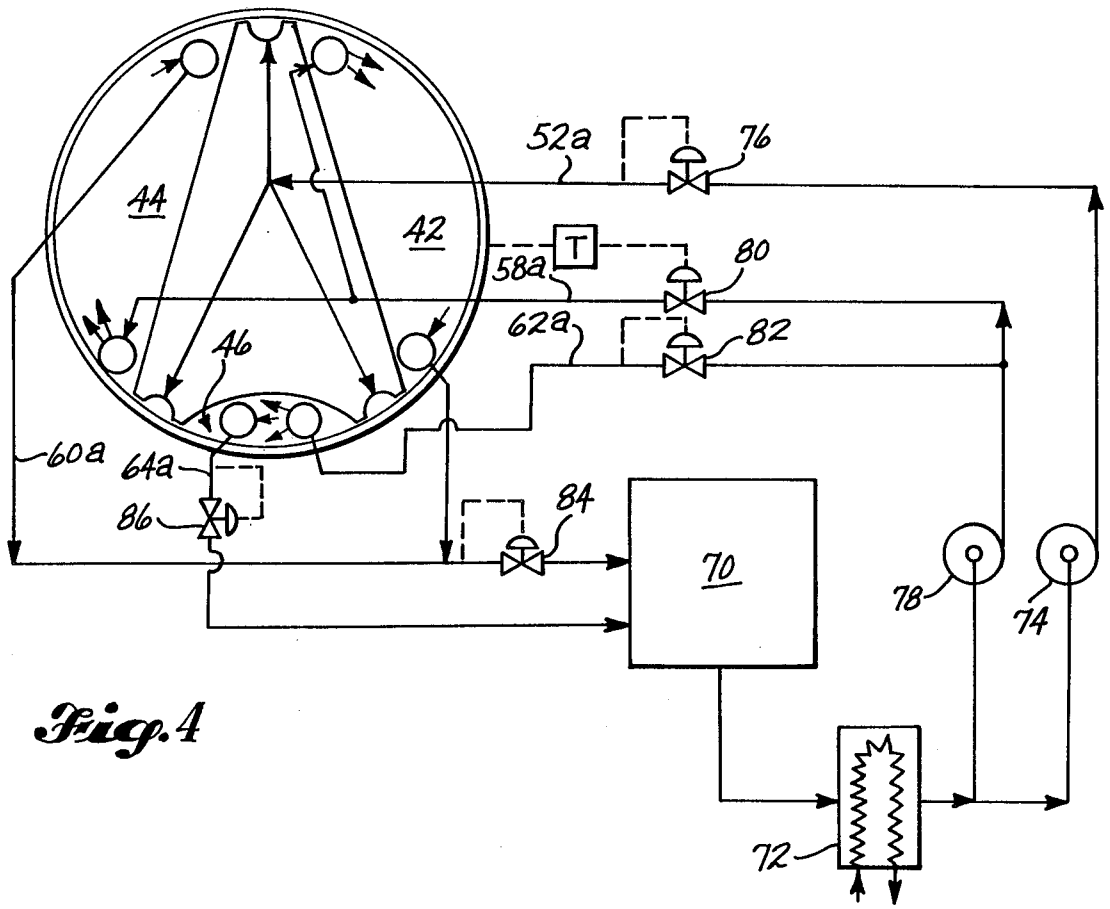
FIG. 4 is a schematic diagram of the heating and fluid control system of the improved drum.

A schematic diagram of the heating and fluid control system is seen in FIG. 4. A reservoir 70 holds a surplus volume of the heating fluid. This is withdrawn through a conventional heater 72 which can be electrical, direct fired, etc. Here the flow splits. A portion goes through a high pressure pump 74 and thence through a regulator/supply valve 76 and line 52*a* to the fluid bearings at the nip support points. Regulator 76 is designed principally to maintain sufficient pressure and/or flow at these bearing points so that the shell is always supported on an adequate film of fluid. Fluid from this source flows over the lands or lips of the bearings where it joins the fluid at lower pressure in the chambers on either side. Regulator 76 may be set to a desired discharge pressure level or to a desired flow volume.

The hot fluid from heater 72 is also directed to a low pressure pump 78. This hot liquid is directed through a low pressure supply valve 80 and through line 58*a* to chambers 42 and 44 located under the distributed load bearing portions of the shell. The return fluid comes from the chambers through line 60*a* and drain valve 84 where it is returned to the reservoir. Supply valve 80 ensures an adequate supply of heat transfer liquid to maintain the desired temperature on the outer surface of the drum. Drain valve 84 controls the fluid pressure to the desired set level.

Interior chamber 46 is preferably supplied from a separate line 62*a* through regulator 82. to facilitate operating at a set pressure differential from chambers 42 and 44. As before, return fluid is collected through line 64*a* and drain valve 86 for return to the reservoir.

Figure 5:
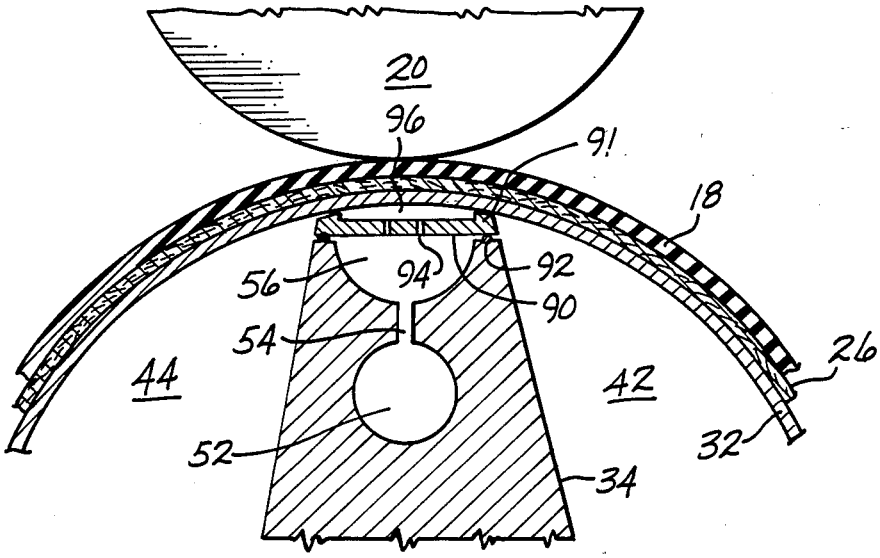

The nip support bearings shown at the apices 36, 38, 40 of interior core portion 34 can assume many forms and do not per se form a part of the present invention. In FIG. 5 a bearing plate 90 overlies reservoir 56. This is united to core 34 and given some flexibility of adjustment through longitudinal gaskets 92. Fluid orifices 94 lead to a secondary reservoir 96. Shell 32 is supported on a fluid film as it flows over bearing plate lands 91 from the higher pressure zone of secondary reservoir 96 to the lower pressures in chambers 42 and 44.

Figure 6:
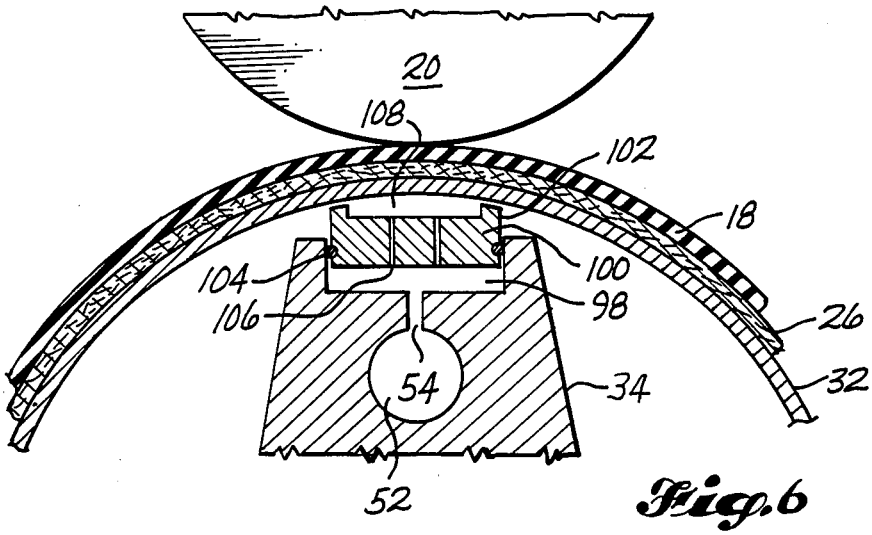
FIGS. 5 to 7 show different bearing arrangements for use within the drum at the nip pressure points.

A somewhat different arrangement is shown in FIG. 6. Here the reservoirs 50 are made into channels 98 having parallel sides. A longitudinally extended piston 100, having lands 102, is sealed into channels 98 by gaskets 104. Orifices 106 supply fluid to the secondary reservoir 108. A bearing of this type facilitates the assembly of the shell and core. It will usually be desirable to have one or more fixed position bearings of the type shown in FIG. 3, preferably two. It may be advantageous to have at least one be the floating self adjusting type of the general configuration pictured in FIG. 6.

Figure 7:
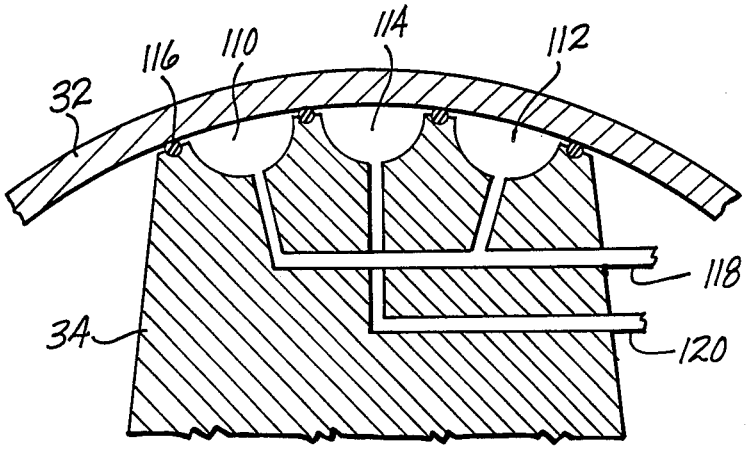
Figure 8:
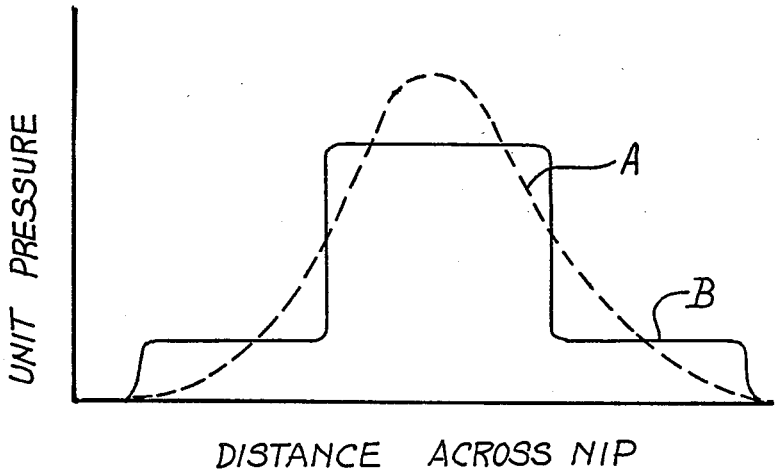
FIG. 8 is a graph showing the pressure distribution in the nip zone using a bearing of the type shown in FIG. 7.

FIG. 7 shows a further general type of bearing which could be desirable in some applications. It consists of side-by-side reservoirs 110, 112, 114 in the apex portion of core 34. This bearing could either be of fixed construction, as is shown here, or of floating construction of the general type shown in FIG. 6. Gaskets 116 between the reservoirs are optional. Channels 110 and 112 receive fluid through line 118 at relatively lower pressure than does center channel 114 which receives its fluid from a higher pressure source through line 120. A bearing of this type enables the pressure to be contoured across the nip zone to closely match the external loading in the nip, as is shown in curve B of FIG. 8. The curve indicated at A is the typical bell-shaped pressure pattern curve of a conventional nip zone.

It will be readily understood that the triangular form shown in the drawings for the axial core portion 34 is simplified and representational. The configuration of this member could assume many forms and one suitable for any particular application is assumed to be within the skill of a competent designer.

Figure 9:
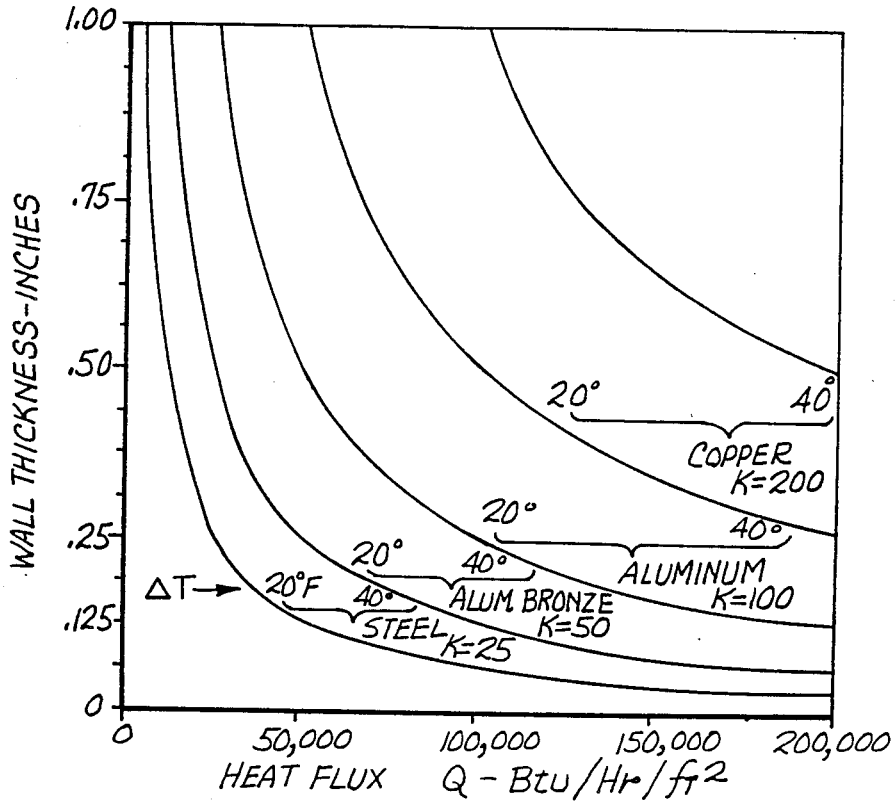
FIG. 9 is a graph showing temperature differential across the drum shell as a function of wall thickness and heat flux for various shell construction materials.

It was noted earlier that the maximum shell thickness for a generally acceptable thermal stress was given by the formula $t=0.2\sqrt{k}$, where t is the shell thickness in inches and k is thermal conductivity expressed in Btu/hr/ft/°F. The value of k for copper is approximately 200, for aluminum it is about 100, for aluminum bronze, approximately 50, and for steel about 25. Using the formula just given, it is evident that maximum shell thicknesses would be about one inch for steel and 3 inches for copper. In actual practice somewhat thinner shells would probably be used. FIG. 9 shows a plot of two levels of temperature differential, for the four materials just previously noted, against heat flow and wall thickness. Assume that one needed a heat flux of 100,000 Btu/hr/ft$^2$ and that it was desired not to exceed 40° F. temperature differential across the shell. These conditions could be met using shell thicknesses for copper of approximately 1.0 inch, for aluminum of 0.5 inches, for aluminum bronze of 0.25 inches, and for steel of 0.125 inches. Significantly heavier shell thicknesses could be used where lower heat flux was acceptable. The internal hydraulic support system of the present roll makes thin shells, of the general range of magnitude just described, quite practical. These are compared with the shells an order of magnitude thicker normally used in rolls subject to heavy nip or distributed loading. It must be emphasized that rolls of the type being described must be able to withstand very severe conditions when in use. A drum for use in a press of the type described in U.S. Pat. No. 4,710,271 might have a diameter in the range of three to six feet and could have a length in the range of 100 to 400 inches. It could have a nip zone loading in the range of 1000 to 2000 pounds per linear inch or greater with unit pressures ranging as high as 1000 psi. The loading between the nips could be as high as 50 psi. Rotational rates up to 300 rpm and surface speeds of 1000 to 5000 ft/min would commonly be expected. These demands appear severe enough, but the requirement of the roll running at temperatures as high as 700° F. to 800° F. makes the service especially severe. These temperatures are well beyond those available by steam heating and require special heat transfer fluids such as Dowtherm A. Dowtherm is a trademark of and is available from Dow Chemical Company, Midland, Mich. The thermal stress that would be experienced by the heavy shell rolls of the prior art simply would be intolerable at the heat flow rates which can be handled by the roll of the present invention.

It will be readily evident to those skilled in the art that many departures and variations can be made in the structures just described without departing from the spirit of the invention. The invention should be considered to be limited only as it is defined by the following claims.

I claim:

1. A drum and belt press of the type comprising a rotatable drum, a belt in tension partially wrapped around the drum, and at least one nip roll acting against the drum through the belt;

the drum further comprising a rotatable outer shell means and a stationary core means axially located within the shell means, said core means having a plurality of first shell support means having close radial clearance with the inner surface of the shell means at each nip roll position, the space between adjacent first support means comprising a pressurizable chamber for supporting the shell between the first support means;

fluid supply lines for conducting a pressurized fluid to each chamber;

fluid discharge lines, spaced apart in the chambers from the supply lines, for conducting the fluid from each chamber for return to a supply source, whereby the first shell support means support the shell against the relatively high forces exerted by the nip roll or rolls, and the pressurizable chambers hydraulically support the shell against the relatively much lower distributed forces exerted by the belt in the zones between the nip roll or rolls.

2. The press of claim 1 which further includes heating means for the fluid, said fluid serving as a heat transfer medium for heating the shell means of the drum.

3. The press of claim 1 in which the thickness of the shell means does not exceed a dimension defined as 0.2 $\sqrt{k}$ inches, where k is the thermal conductivity of the shell material expressed as Btu/hr/ft/°F.

4. The press of claim 1 in which the drum inner core means is profiled in at least one chamber in the space between the first fluid supply line and the fluid discharge line to distribute fluid flowing between them along the inside surface of the shell.

5. The press of claim 1 in which, along any radial line, the hydraulic support unit pressure any at point inside the rotating shell is at least half the unit mechanical pressure at the corresponding point on the outer surface of the shell.

6. The press of claim 1 which further comprises a pair of essentially parallel, spaced apart belt tensioning rolls adjacent to and parallel to the drum, the belt being endless and having an inner generally U-shaped course and an outer generally U-shaped course, the inner and outer courses meeting in loops which wrap around the tensioning rolls, The tensioning rolls being contained within the body of the belt and the drum being outside the body of the belt, said inner course of the belt being wrapped around more than half the circumference of the drum, at least one idler nip roll also being contained within the body of the belt so that the inner and outer courses of the belt are spaced apart, the tensioning rolls and idler nip roll or rolls all being in nip contact with the drum through the belt.

drive means for the belt, and tensioning means acting on the tensioning rolls to translate them relatively toward or away from each other to control belt tension while still maintaining nip contact of all the rolls.

7. The press of claim 6 in which the drum is free floating with respect to the tensioning rolls for relative movement in response to tensioning adjustments.

8. The press of claim 1 in which the first shell support means of the drum comprise pressurized fluid-type bearings.

9. The press of claim 8 in which at least one of said fluid-type bearings is fixed in position.

10. The press of claim 8 in which two of said fluid-type bearings are in fixed position.

11. The press of claim 8 in which at least one of said fluid bearings is a floating self adjusting type.

12. The press of claim 8 which further has a second fluid supply line for supplying pressurized fluid to the fluid-type bearings.

13. The press of claim 8 in which the first shell support means of the drum are longitudinally continuous over essentially the full length of the drum.

14. A drum or roll assembly which comprises:

a rotatable, essentially rigid outer shell means;

an inner core means located axially within the shell means, said core means having a plurality of circumferentially spaced apart first shell support means having close radial clearance with the inner surface of the shell means, the spaces between adjacent first support means comprising pressurizable chambers to provide support for the shell in the angular spaces between said first support means;

first fluid supply lines for conducting a pressurized fluid to each chamber;

fluid discharge lines, spaced apart in the chambers from the first fluid supply lines, for conducting the fluid from each support chamber for return to a supply source;

said roll in use being capable of withstanding high nip roll forces applied at the location of some or all of the first support means and the relatively much lower distributed forces applied over the surface area between said first support means without undue shell stress.

15. The drum or roll of claim 14 in which the thickness of the shell means does not exceed a dimension defined as 0.2 $\sqrt{k}$ inches, where k is the thermal conductivity of the shell material expressed as Btu/hr/ft/°F.

16. The drum or roll of claim 14 in which the inner core is profiled in the chamber area in the space between the first fluid supply line and the fluid discharge line to distribute fluid flowing between them along the inside surface of the shell.

17. The drum or roll of claim 14 in which the first shell support means comprise pressurizable fluid-type bearings.

18. The drum or roll of claim 17 in which at least one of said fluid-type bearings is fixed in position.

19. The drum or roll of claim 17 in which two of said fluid-type bearings are in fixed position.

20. The drum or roll of claim 17 in which at least one of said fluid bearings is a floating type.

21. The drum or roll of claim 17 which further has a second fluid supply line for supplying pressurized fluid to the fluid-type bearings.

22. The drum or roll of claim 17 in which the first shell support means are longitudinally continuous over essentially the full length of the roll.

23. The press of claim 1 in which at least three angularly spaced apart nip rolls make nip contact with the drum through the belt.

24. The press of claim 23 in which two of the nip rolls also serve as belt tensioning rolls.

* * * * *